US011000130B1

(12) United States Patent
Wollschlager

(10) Patent No.: US 11,000,130 B1
(45) Date of Patent: May 11, 2021

(54) INTEGRATED MATTRESS COVER HANDLE

(71) Applicant: Lawrence Wollschlager, El Paso, TX (US)

(72) Inventor: Lawrence Wollschlager, El Paso, TX (US)

( * ) Notice: Subject to any disclaimer, the term of this patent is extended or adjusted under 35 U.S.C. 154(b) by 0 days.

(21) Appl. No.: 16/558,884

(22) Filed: Sep. 3, 2019

(51) Int. Cl.
*A47C 31/10* (2006.01)
*A47C 31/08* (2006.01)

(52) U.S. Cl.
CPC ..... *A47C 31/105* (2013.01); *A47C 31/08* (2013.01)

(58) Field of Classification Search
CPC ..... A47C 31/105; A47C 31/08; A47C 31/02; A47C 31/10; A47C 27/002; A47C 23/18; A47C 31/002
See application file for complete search history.

(56) References Cited

U.S. PATENT DOCUMENTS 5,896,605 A * 4/1999 Branman ..... A47C 21/00 5/716
2010/0162486 A1* 7/2010 Joyce ..... A47G 9/0238 5/485
2011/0253770 A1* 10/2011 Resta ..... A47C 31/08 229/87.04
2014/0059779 A1* 3/2014 Antinori ..... A47C 31/08 5/703
2019/0254437 A1* 8/2019 Hall ..... A47C 27/16

FOREIGN PATENT DOCUMENTS

EP 0603052 A1 * 6/1994 ..... A47C 31/08

* cited by examiner

*Primary Examiner* — Nicholas F Polito
*Assistant Examiner* — George Sun
(74) *Attorney, Agent, or Firm* — Edwin H. Crabtree; Ramon L. Pizarro

(57) ABSTRACT

A mattress cover handle integrated into a mattress cover. The mattress cover is used for covering a mattress on a bed frame. The mattress cover handle include a first horizontal pocket in a first side panel of the mattress cover. Also, a second horizontal pocket in a second side panel can be integrated into the mattress cover. A back side of the first horizontal pocket and a back side of the second horizontal pocket includes webbing or reinforcing tape. The tape can extend along a length of the first and second side panels and sewn next to the sides of the pockets for reinforcing the strength of the pockets. Also, the first and second pockets include seams, which are hemmed around the sides of the each pocket.

14 Claims, 2 Drawing Sheets

FIG. 3
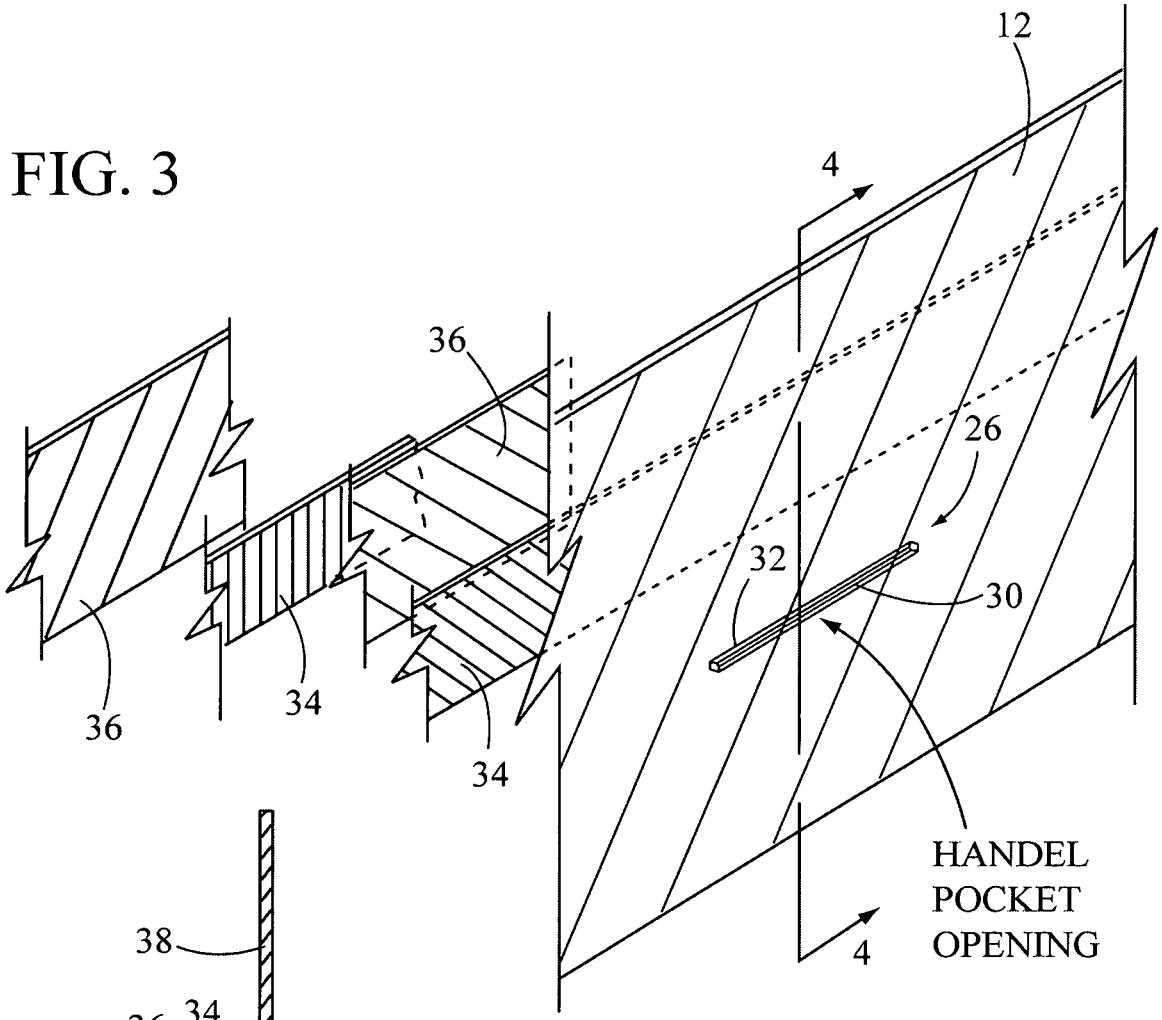
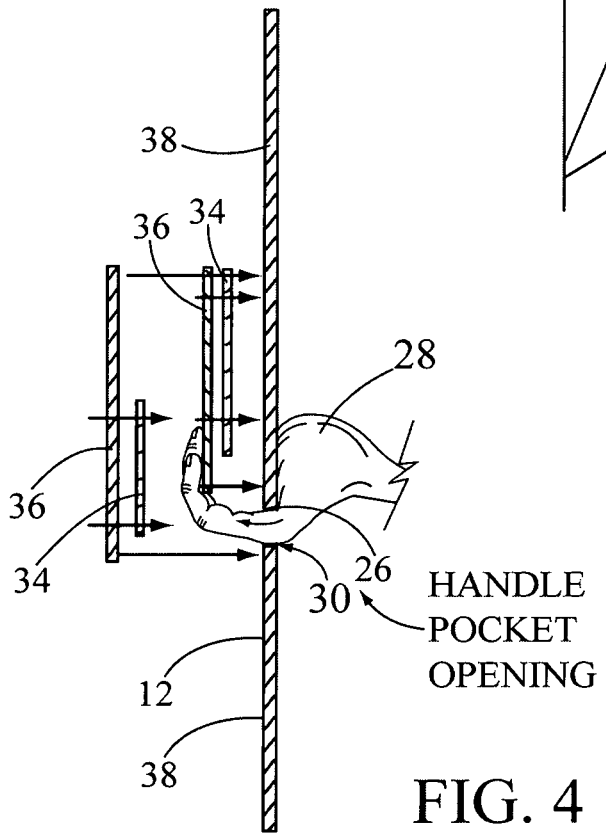
FIG. 4

INTEGRATED MATTRESS COVER HANDLE

BACKGROUND OF THE INVENTION

(a) Field of the Invention

This invention relates to an integrated mattress cover handle in a form of a pocket in a side panel of a mattress cover and more particularly, but not by way of limitation, to a pair of mattress cover handles in opposite side panels in the mattress cover. The mattress cover handle is built into the mattress cover in a discrete manner as to not deter from the overall aesthetics of the mattress cover design.

(b) Discussion of Prior Art

Heretofore, mattresses have included outwardly extending handles on opposite sides of a mattress for lifting and adjusting the mattress on a box spring. A fabric, used in making a mattress cover for covering a mattress, is not sufficient in strength to include handles, which can lead to a tearing of the fabric. In U.S. Pat. No. 3,859,679 to Bartz, a good example of a flexible mattress handle is shown and attached to a pair of coil springs inside the mattress. The subject invention eliminates unsightly and unusable mattress handles and incorporates integrated mattress cover handles in opposite side panels of the mattress cover. The mattress cover handles, in the form of pockets, are discrete and attractive in appearance, yet strong enough for lifting and adjusting a bed mattress.

SUMMARY OF THE INVENTION

In view of the foregoing, it is a primary objective of the subject invention to eliminated the use of mattress handles in opposite side of a mattress and provide mattress cover handles, in the form of pockets, in opposite sides of a mattress cover.

Another object of the invention is the mattress cover handles are discrete in appearance, attractive in appearance, and are strong enough for lifting and adjusting a bed mattress.

Still another object of the invention is the mattress cover handles can be incorporated into various sizes of mattress covers, for covering king size, queen size, twin size mattress, along with custom made mattresses. The mattress cover handles, in the form of pockets, are reinforced by adding reinforcing tape or webbing sewn to an inside of the side panels of the mattress cover and next to the sides of the pockets.

The subject invention includes one or more mattress cover handles integrated into a mattress cover. The mattress cover is used for covering a mattress on a bed frame. The mattress cover handles include a first horizontal pocket in a first side panel of the mattress cover and a second horizontal pocket in a second side panel of the mattress cover. A back side of the first horizontal pocket and a back side of the second horizontal pocket includes webbing or reinforcing tape extending along a length of the first and second side panels and sewn next to the sides of the pockets. The first and second pockets includes seams, which are hemmed around sides of the each pocket.

These and other objects of the present invention will become apparent to those familiar with mattress handles and mattress covers when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject mattress cover handle, and in which:

FIG. 3 is an exploded perspective view illustration strips of reinforcing tape or webbing and strips of fabric positioned to be sewn to a back side of a side panel of the mattress cover.

FIG. 4 is a side view of the strips of tape and strips of fabric positioned next to the back side of the side panel, shown in FIG. 3.

DETAILED DESCRIPTION OF THE PREFERRED EMBODIMENTS

Figure 1:
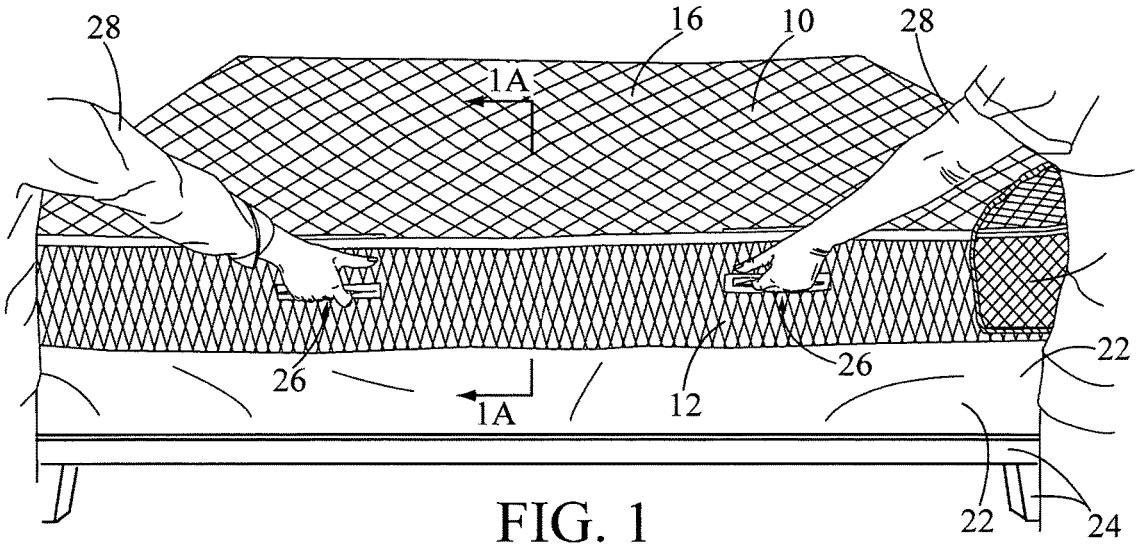
FIG. 1 is a perspective view of a mattress cover used for covering a mattress. A pair of mattress cover handles are shown gripped by two human hands and used for adjusting or moving the mattress.

In FIG. 1, a perspective view of a mattress cover 10 is shown having a first side panel 12, a second side panel 14, a top 16 and a bottom 18. The mattress cover 10 is designed to cover a bed mattress 20. A portion of the cover 10 has been cutaway to show the mattress 20. The mattress 12 rest on top of a bed box spring 22 and bed frame 24. In this drawing, a pair of spaced apart, first mattress cover handles, having general reference numeral 26. The handles 26 are shown gripped by fingers or two human hands 28 and used for adjusting or moving the mattress 20.

As mentioned above, the mattress cover handles 26 are in a form of discrete horizontal pockets. The pockets are cut into horizontal slits or pocket openings in the mattress cover 10 and then hemmed around the opening to form a seam 32. The pocket openings typically have a width in a range of 5 to 8 inches. The seam 32 reinforces the pocket opening to prevent a tearing of the mattress cover.

Figure 1A:
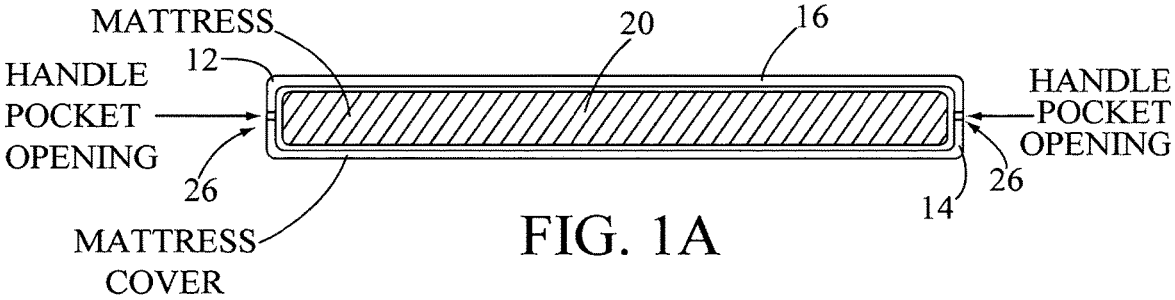
FIG. 1A is a sectional view of the mattress and mattress cover taken along lines 1A-1A, shown in FIG. 1.

In FIG. 1A, a sectional view of the mattress 30 and the mattress cover 10 are shown and taken along lines 1A-1A, shown in FIG. 1. In this view, the mattress cover handle 26 is shown formed in both the first side panel 12 and the second side panel 14.

Figure 2:
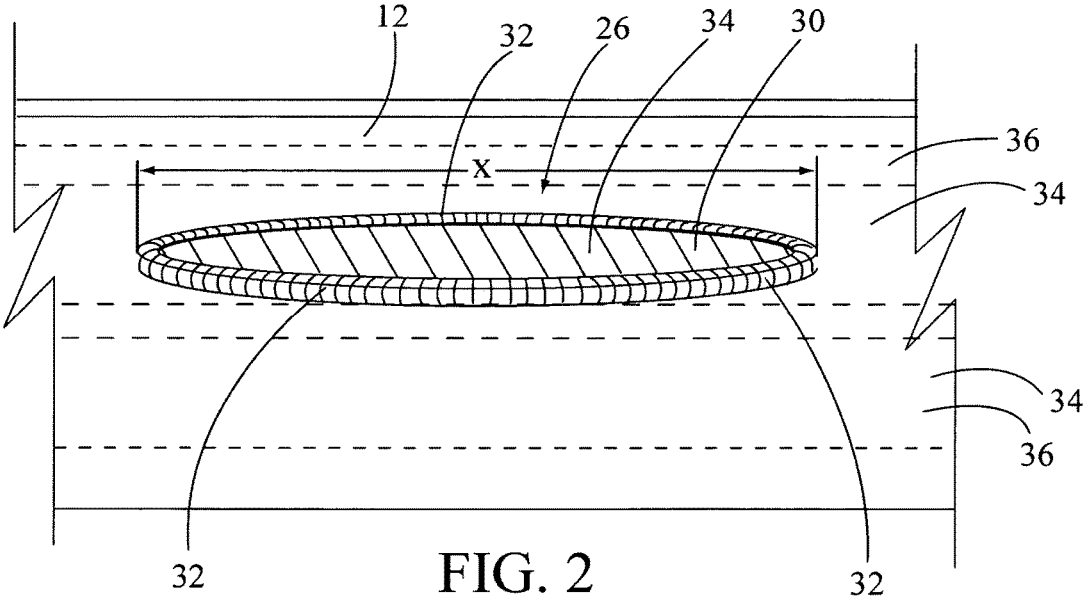
FIG. 2 is a front view of one of the mattress cover handles, in the form of a pocket, in an open position.

In FIG. 2, an enlarged front view of one of the mattress cover handles 26 is shown in the form of a pocket, with a horizontal pocket opening 30 in an open position. Sides of the pocket opening 30 are hemmed to form a seam 32 therearound to prevent the tearing of the sides of the opening. In this drawing, dashed lines illustrate added strips of webbing or reinforcing tape 34 and added strips of reinforcing cloth fabric 36. The tape 34 and the fabric 36 are sewn to a back side 38 of the first side panel 12 and on opposite sides of the pocket opening 30 to reinforce the strength of the mattress cover handle 26. The tape 34 and the fabric 36 are shown more clearly in FIGS. 3 and 4. Also, a portion of the tape 34 is shown in this drawing. The handles 26 formed in the second side panel 14 are the same as those formed in the first side panel 14. The pocket opening 30 typically has a width "X" in a range of 5 to 8 inches.

In FIG. 3, an exploded perspective view is shown of a pair of parallel strips of reinforcing tape 34 and a pair of parallel strips of reinforcing fabric 36. The two tapes 34 and the two fabrics 36 are shown positioned to be sewn to the back side 38 of the first side panel 12 of the mattress cover 10 and reinforce the sides of the pocket opening 30.

In FIG. 4, a side view of the strips of tape 34 and the strips of fabric 36 are positioned next to the back side 38 of the first side panel 12, shown in FIG. 3. Arrows 40 are shown to indicate the strips of tape 34 and fabric 36 to be sewn to the first side panel 12. The strips of tape 34 and fabric 36 typically extend a length of the first side panel 12 and the second side panel 14.

Referring now to both FIG. 2 and FIG. 4, when the human hand 28 reaches through the pocket opening 30, the fingers of the hand 28 touch a portion of the reinforcing tape 34, with the reinforcing fabric 36 sewn to the back of the tape. In this manner the tape and fabric provide reinforcement and strength to the back side of the mattress cover handle 26.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A mattress cover handle integrated into a mattress cover, the mattress cover is used for covering a mattress on a bed frame, the mattress cover handle comprising:

a horizontal first pocket adapted for being formed in a first side panel of the mattress cover;

reinforcing tape sewn on a back side of the first pocket for reinforcing the strength of the first pocket, the reinforcing tape extending along a length of the first side panel, and including strips of fabric sewn to an interior side of the reinforcing tape and next to the back side of the first pocket for reinforcing the strength of the first pocket, the strips of fabric extending along the length of the first side panel.

2. The mattress cover handle as described in claim 1 wherein the first pocket includes a seam, the seam hemmed around sides of the first pocket.

3. The mattress cover handle as described in claim 1 further including a horizontal second pocket adapted for being formed in a second side panel of the removable mattress cover and reinforcing tape sewn on a back side of the second pocket for reinforcing the strength of the second pocket, the reinforcing tape extending along a length of the second side panel.

4. The mattress cover handle as described in claim 3 wherein the second pocket includes a seam, the seam hemmed around sides of the second pocket.

5. The mattress cover handle as described in claim 3 wherein the first and second pockets have a width "X" in a range of 5 to 8 inches.

6. A mattress cover handle integrated into a mattress cover, the mattress cover is used for covering a mattress on a bed frame, the mattress cover handle comprising:

a pair of spaced a part, horizontal first pockets adapted for being formed in a first side panel of the mattress cover;

reinforcing tape sewn next to a backside of the first pockets for reinforcing the strength of the first pockets, the reinforcing tape extending a long a length of the first side panel, and including strips of fabric sewn to an interior side of the reinforcing tape and next to the back side of the first pockets for reinforcing the strength of the first pockets, the strips of fabric extending along the length of the first side panel.

7. The mattress cover handle as described in claim 6 wherein the first pockets include a seam, the seam hemmed around sides of the first pockets.

8. The mattress cover handle as described in claim 6 further including a pair of spaced apart, horizontal second pockets adapted for being formed in a second side panel of the mattress cover and reinforcing tape sewn next to a back side of the second pockets for reinforcing the strength of the second pockets, the reinforcing tape extending along a length of the second side panel.

9. The mattress cover handle as described in claim 8 wherein the second pockets includes a seam, the seam hemmed around sides of the second pockets.

10. The mattress cover handle as described in claim 8 wherein the first and second pockets have a width "X" in a range of 5 to 8 inches.

11. A mattress cover handle, the mattress cover handle comprising:

a mattress cover having a top, a bottom, a first side panel and a second side panel;

a pair of spaced apart, horizontal first pockets formed in the first side panel of the mattress cover;

a pair of spaced apart, horizontal second pockets formed in the second side panel of the mattress cover;

reinforcing tape sewn on a back side of the first pockets and on a back side of the second pockets for adding strength to the first and second pockets, the reinforcing tape extending along a length of the first side panel and along a length of the second side panel, and including strips of fabric sewn to an interior side of the reinforcing tape and next to the back side of the first pockets and the back side of the second pockets for reinforcing the strength of the first and second pockets, the strips of fabric extending along the length of the first side panel and along the length of the second side panel.

12. The mattress cover handle as described in claim 11 wherein the first pockets and the second pockets include a seam, the seam hemmed around sides of the first pockets and the second pockets.

13. The mattress cover handle as describe in claim 11 further including strips of fabric sewn next to the reinforcing tape and next to the back sides of the first and second pockets for reinforcing the strength of the pockets, the fabric extending along a length of the first and second side panels.

14. The mattress cover handle as described in claim 11 wherein the first and second pockets have a width "X" in a range of 5 to 8 inches.

* * * * *